United States Patent [19]

Flagg et al.

[11] 3,964,062

[45] June 15, 1976

[54] KEYBOARD SWITCH SYSTEM

[75] Inventors: Delbert Flagg, Huntington Beach; Miroslaw Balodis, Garden Grove, both of Calif.

[73] Assignee: Signal Laboratories, Inc., Orange, Calif.

[22] Filed: Dec. 9, 1974

[21] Appl. No.: 530,936

[52] U.S. Cl. ..... 340/365 L; 340/365 R; 331/117 R

[51] Int. Cl.[2] ..... G08C 1/00

[58] Field of Search ..... 340/365 L

[56] References Cited

UNITED STATES PATENTS

| | | | |
|---|---|---|---|
| 3,648,117 | 3/1972 | Yamamoto | 340/365 L |
| 3,707,686 | 12/1972 | Uekusa | 340/365 L |
| 3,772,684 | 11/1973 | Scantlin | 340/365 L |

*Primary Examiner*—Thomas B. Habecker
*Attorney, Agent, or Firm*—Blakely, Sokoloff, Taylor & Zafman

[57] ABSTRACT

A keyboard switch system for stenographic machines whereby electrical signals corresponding to key depression may be derived. The switch system is comprised of a plurality of coils each having a coil parameter effecting plunger coaxial therewith and spring loaded to an upper position. The coils are arranged in an assembly so as to be mountable in the stenographic machine with the plunger disposed so as to be contaced and depressed in response to depression of a respective key. Each of the coils form a part of a tuned circuit with plunger position affecting the resonant characteristics so as to create logic levels response to key position.

14 Claims, 11 Drawing Figures

Fig. 1
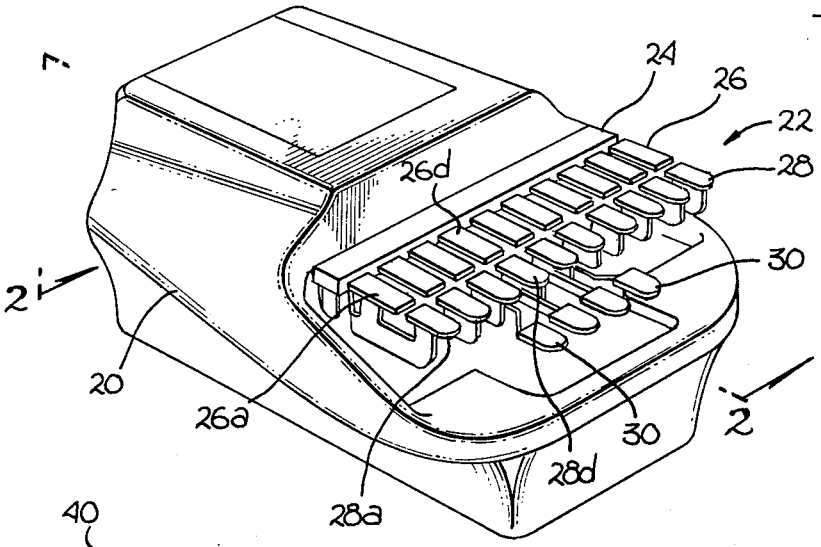
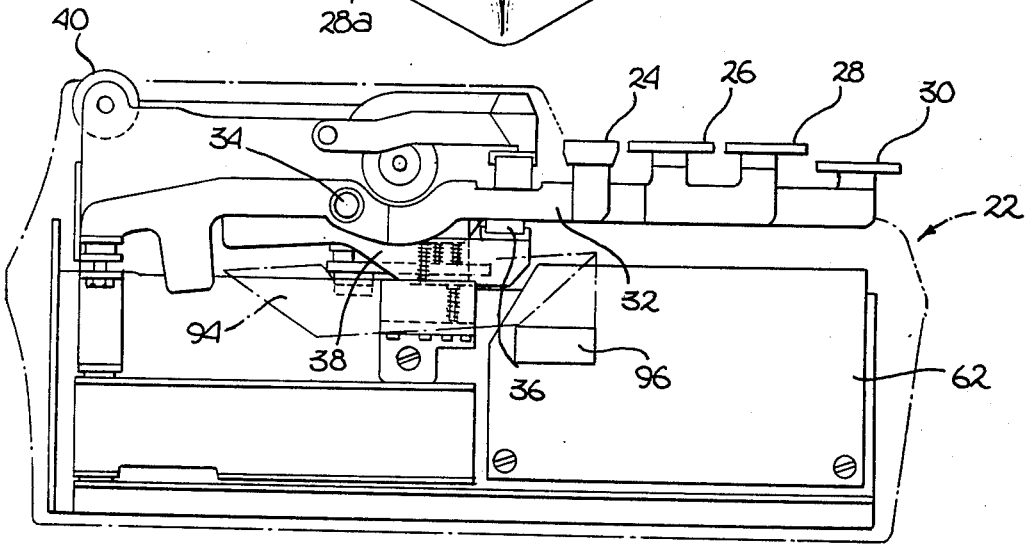
Fig. 2
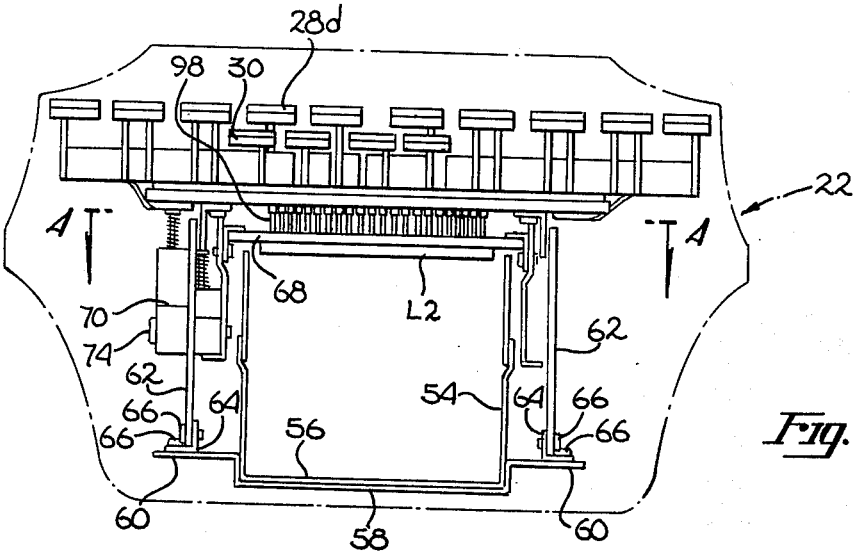
Fig. 3

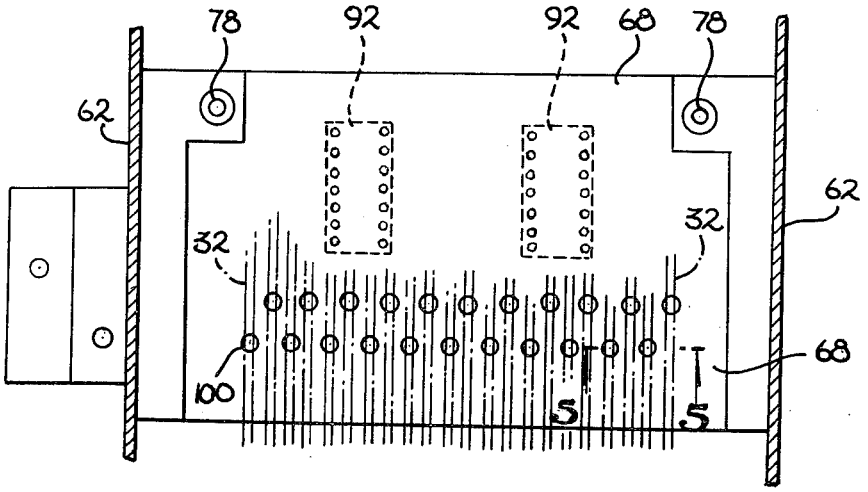
Fig. 4
Fig. 5
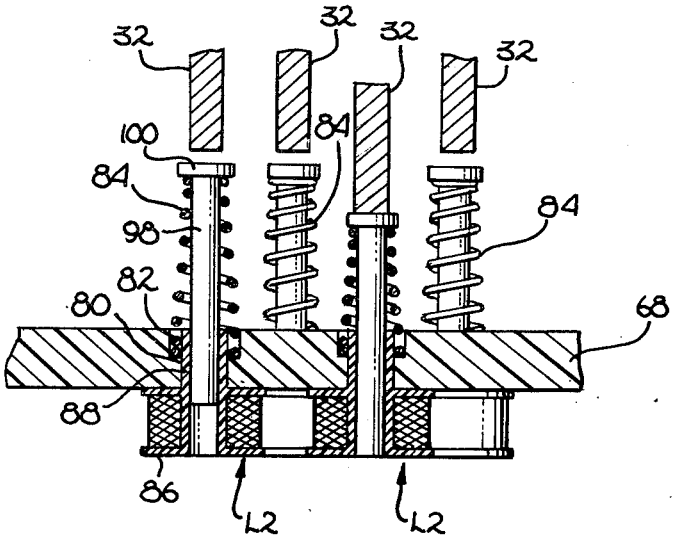
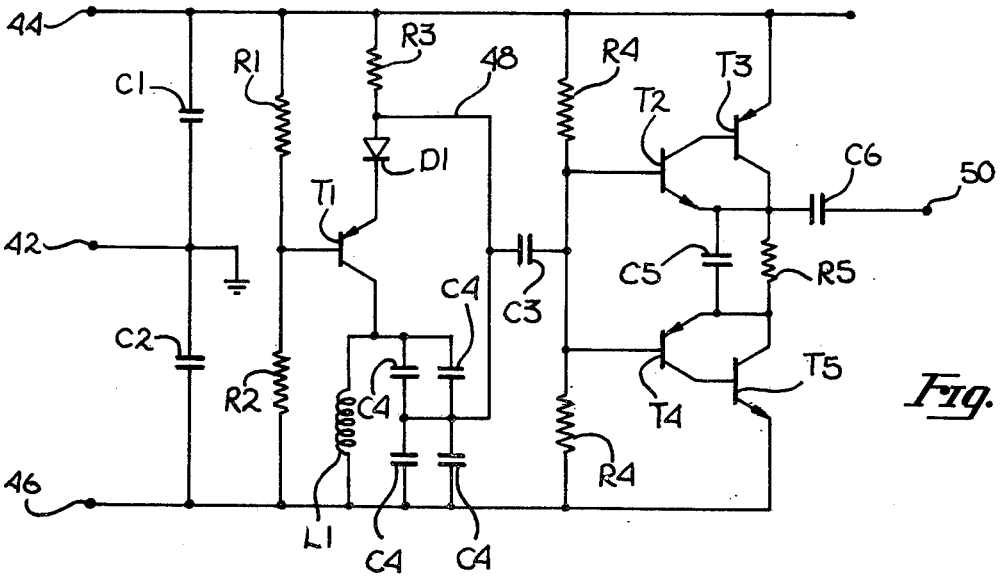
Fig. 6

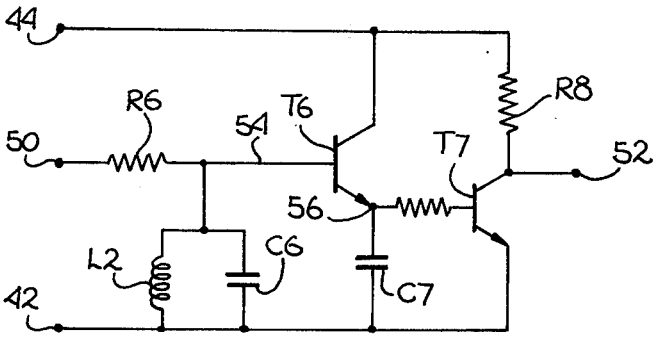
Fig. 7
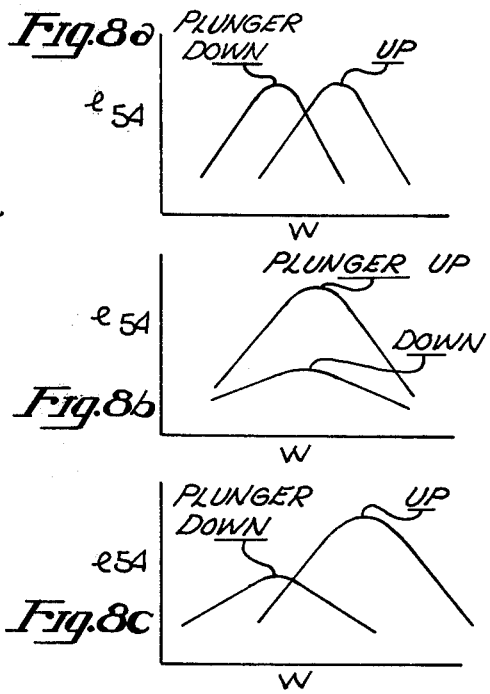
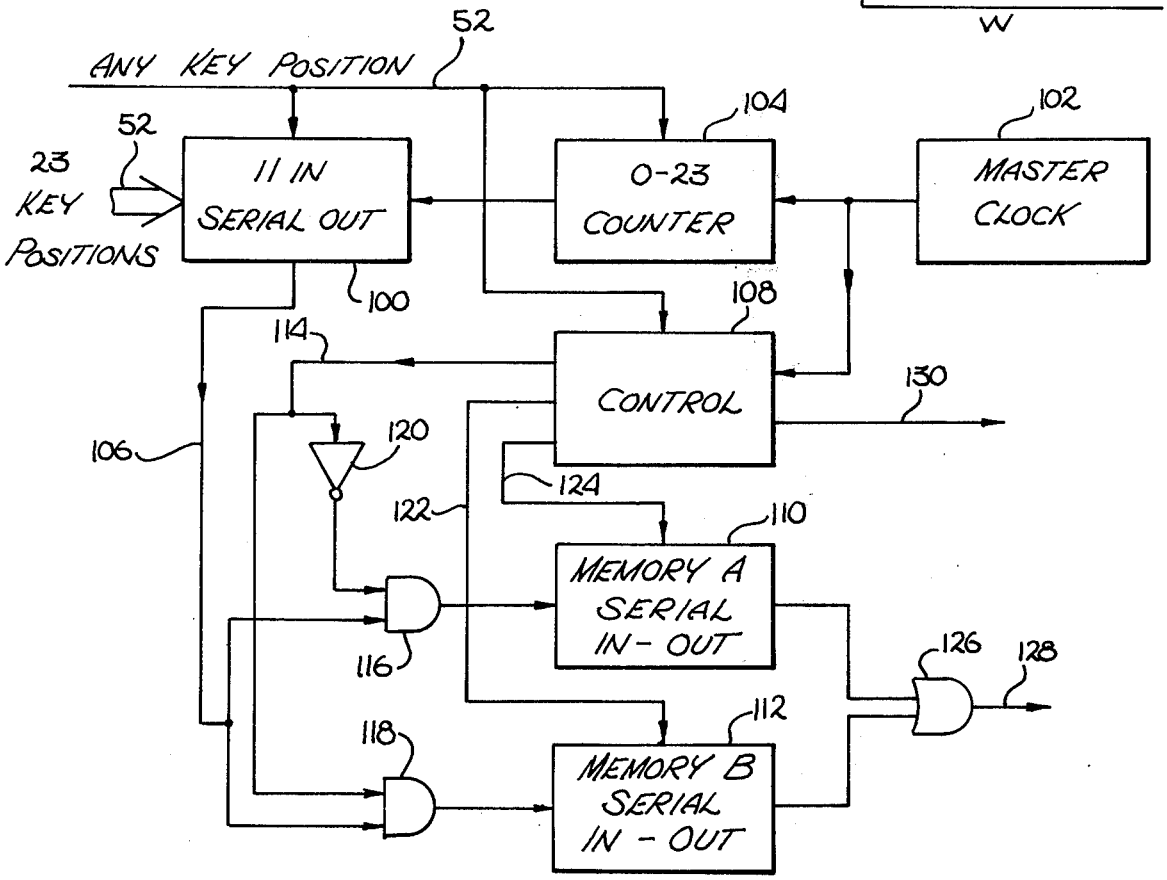
Fig. 9

KEYBOARD SWITCH SYSTEM

BACKGROUND OF THE INVENTION

1. Field of the Invention

The present invention relates to the field of information recording equipment, and particularly to equipment for recording on a medium such as tape information derived from a keyboard input such as a stenographic machine keyboard.

2. Prior Art

In many situations, there is a need to record conversations and the like and to provide a printed copy thereof at both a high speed and with high accuracy in content. While the desired final product may readily be produced by a conventional typewriter, the speed of even the best typist is not sufficient to record the spoken words at normal speech rates. Therefore, some intermediate recording technique and medium is generally utilized to record the spoken word in some form which later is transcribed to provide the desired printed finished product.

In many situations, the spoken word is recorded by a stenographer using some form of shorthand, and later transcribed by the stenographer to the desired end product. Differences in shorthand techniques however, may make it difficult or impossible for one person to read another person's shorthand so that the shorthand record may be of little lasting value. In other situations, the spoken word is directly recorded on magnetic tape for later playback and transcription. In ideal situations, such a technique is highly satisfactory, as background noise, etc. may be controlled, the voices are generally known, and questions may be asked wherever the taped information is unclear. However, in other situations, such as by way of example, in a typical court reporting atmosphere, whether in depositions or actual court room recording, this technique has been found to be unsatisfactory for various reasons. For instance, in some situations the information thought to be taken is masked by background noises, different voices are sometimes not readily distinguishable so that the speaker cannot be later identified; malfunction of the equipment is not always visually apparent, etc. Accordingly, the steno machine is substantially universally used for this type of recording. Such a machine utilizes a keyboard of a predetermined number of characters which, in various combinations, may be used to provide a phonetic recording of the spoken word for later transcription. Such a machine typically provides a printout on paper providing a permanent record which is immediately reviewable to insure proper recording and which in general may be transcribed by someone other than the person doing the recording.

It would be highly desirable to provide a means for automatic transcription of the steno recording so that preferably a finished printed output could be immediately and quickly derived, or a printed output having a minimum number of grammatical errors could be quickly produced, which then could be read and corrected in minimum time by the reporter. Computer programs for transcribing the recorded information, which typically is a phonetic representation of the spoken word, are presently known and are currently the subject of considerable effort for the improvement thereof. Also, various devices and systems are known for converting the key depression into electrical signals which may be recorded and placed in compatible form for input to a computer programmed to transcribe the information. It is such a system that the present invention is directed.

Prior art systems for providing an electrical signal in response to key depression utilize variable inductance devices and switching devices. The variable inductance devices have generally been comprised of a stationery wound magnetic member disposed adjacent to a portion of a respective key so that the inductance of the device is affected by the relative location of the key. Such devices depend upon the magnetic characteristics of the key, and other parameters which otherwise are of no interest to the manufacturer of the steno machine, so that performance of the variable inductance sensor may be limited and have to be matched to the magnetic characteristices of the key. Also, such systems as are noted in the prior art, have utilized RL circuits, which circuits are not the most sensitive to provide a high level output. Other systems have used variable inductors as a frequency determining component in an oscillator circuit, so that the frequency of oscillation is responsive to key depression. These systems generally provide for detection by a low pass filter, with the sensitivity of the system being determining by the amount of frequency shift and by the sharpness of the cutoff of the low pass filter. Since one entire circuit is required for each key, the overall system is rather complex and expensive, and may be quite sensitive to the proper adjustment of the various components. Prior art systems utilizing mechanical switches, of course, provide the desired information but are subject to the well known problems of switches, including contamination, oxidation, noise, mechanical failure, etc.

An ideal key position sensing system is a system which is relatively simple and inexpensive to fabricate, which provides high level output signals, and which may be separately fabricated and installed into existing and new steno machines without substantial alteration thereof and without special requirements in such machines.

BRIEF SUMMARY OF THE INVENTION

A keyboard switch system for stenographic machines whereby electrical signals corresponding to key depression may be derived. The switch system is comprised of a plurality of coils each having a coil parameter effecting plunger coaxial therewith and spring loaded to an upper position. The coils are arranged in an assembly so as to be mountable in the stenographic machine with the plunger disposed so as to be contacted and depressed in response to depression of a respective key. Each of the coils form a part of a tuned circuit with plunger position affecting the resonant characteristics so as to create logic levels response to key position. An oscillator is provided for driving all of the tuned circuits through a respective impedance so that a change in the tuned circuit characteristics will result in a change in voltage across the tuned circuit. A rectifying amplifier is provided for each tuned circuit to provide first and second logic level outputs responsive to the voltage across the tuned circuit and thus the respective key position. The outputs of the rectifying amplifiers are strobed into a register by the "ANY KEY" bar position signal and are clocked into either a first or a second memory, the first and second memories being controlled so as to be readable while the other of the first and second memories is receiving information from the keyboard switch system.

BRIEF DESCRIPTION OF THE DRAWINGS

FIG. 1 is a prospective view of a typical steno machine which may utilize the present invention.

FIG. 2 is a cross-section of the steno machine of FIG. 1 illustrating the general arrangement of the circuit boards of the present invention.

FIG. 3 is the front view of the steno machine of FIG. 1 with the case thereof shown in phantom.

FIG. 4 is a cross-section taken along line 4—4 of FIG. 3.

FIG. 5 is a partial cross section taken on an expanded scale along lines 5—5 of FIG. 4.

FIG. 6 is a circuit diagram for an oscillator which may be used in the present invention.

FIG. 7 is a circuit diagram for the tuned circuit and the rectifying amplifier which may be utilized with the present invention.

FIGS. 8*a* through 8*c* are frequency response diagrams illustrating the changes in characteristics of the tuned circuit with key position.

FIG. 9 is a block diagram illustrating the manner in which the keyboard switch outputs are temporarily stored for more convenient delivery to a recording or utilization device.

DETAILED DESCRIPTION OF THE INVENTION

First referring to FIG. 1, a perspective view of a typical steno machine may be seen. The specific type of machine shown is a Stenograph machine and will be used herein for purposes of explanation to illustrate the manner in which the present invention may be applied to this type of machine. It is to be understood, however, that other makes and types of steno machines are also currently in general use, and the present invention may be readily applied to these other types of machines by one skilled in the relevant art.

The steno machine is characterized by a case 20 enclosing the mechanism of the machine, with a keyboard generally indicated by the numeral 22 at front thereof. As may be seen in FIG. 1, the keyboard is comprised of a rear number bar 24, ten character bars 26 just forward of the number bar 24, additional character bars 28 forward of the bars 26, and four additional character bars 30 at the forwardmost area of the keyboard, making the apparent number of key selections equal to twenty-five, however, keys 26*a* and 28*a* are common and comprise one key, as does keys 26*d* and 28*d*. Accordingly, there are twenty-three separate independently operable keys, which are generally operated simultaneously in varying combinations to provide the phonetic printout. In comparison to a typewriter, it should be noted that in general, a combination of keys will be depressed approximately simultaneously, rather than sequentially as on a typewriter, and the characters provided on any one line of the printout will be all those characters for which the respective key was depressed sometime between the time a first key was depressed and the first time thereafter when all keys were returned to the proper position. Thereafter, a sequential depression of any key will result in a printout of the respective character on the next line.

Now referring to FIG. 2, a crossection of the machine in FIG. 1 taken along lines 2—2 of that figure may be seen. The various keys 24, 26, 28 and 30 are interconnected with respective ones of key bars 32, rotationally mounted about a common axis in 34. The key bars 32 are each fabricated of sheet metal and are bent in a predetermined manner so as to each support the appropriate keys in the appropriate positions. The key bars, however, generally have substantially the same planform in the areas relative to the present invention, so that the individual key bars need not be distinguished for this purpose.

There is also mounted on the same common axis 34 an "any key" bar 38 with any key cross bar 36 disposed just below the key bars 32 so as to be depressed by any of the key bars which may be depressed. Accordingly, though there are 23 key selections, as previously mentioned, the depression of any key will also depress the any key cross bar 36 which advances the paper roller 40 and results in a printout, on a single line, of any characters for which the keys are depressed during any one depression of the any key bar 36. (The any key bar 36 may not be separately manually depressed, as no separate manual key is provided for this purpose, but instead is depressed with the first of keys 24, 26, 28 and 30 to be depressed for any line of phonetic character to be printed.)

Before describing the mechanical arrangements of the present invention, the circuit schematic thereof will first be described. Thus, referring to FIG. 6, the schematic diagram of the oscillator circuit which may be used with the present invention may be seen. This oscillator circuit utilizes three voltage inputs. These are a ground terminal 42, a positive power supply terminal 44, preferably connected to a 5.0-volt supply, and a negative power supply terminal 46, preferably connected to a minus 12-volt supply.

Capacitors C1 and C2, relatively large valued capacitors, provide power supply filtering or noise suppression. Resistors R1 and R2 provide a voltage divider to establish the voltage on the base of transistor T1 at a value generally intermediate to voltages on terminals 44 and 46. In the emitter circuit of transistor T1 is a diode D1 and resistor R1, with a connection there between on line 48 being coupled to capacitor C3 and to four capacitors C4 in a series-parallel combination. The capacitors C4 coupled between terminal 46 and the collector of transistor T1 provide an effective capacitance there between equal to the capacitance of any one capacitor C4, though the specific combination of four such capacitors provide capacitance coupling (DC isolation) between the emitter circuit and the collector circuit through line 48. Also coupled in parallel in the collector circuit of transistor T1 is an inductor L1, so that the resonant frequency determined by inductors L1 and the four capacitors C4 is given by the equation $W = \sqrt{1/L1C4}$. Thus, this part of the circuit operates as a colpitts oscillator, with the voltage appearing on line 48 being a relatively pure sine wave at the oscillation frequency thereof.

Capacitor C3 couples the oscillator voltage to the output circuit of the oscillator, with the capacitor in conjunction with resistors R4 providing a level shifting circuit to couple the oscillation to the base input of the complementary pair of Darlington transistor pairs comprising transistors T2 and T3, and T4 and T5 respectively. These two Darlington pairs together with resistors R5 and capacitor C5 provide a relatively lower distortion high quality sine wave output for the oscillator circuit, with capacitors C6 further providing DC isolation of the output signals appearing on terminal 50.

Now referring to FIG. 7, a circuit diagram representative of the circuit used for each of the key and the any key bar may be seen. A capacitor C6 together with an inductor L2 form a resonant circuit driven by the voltage appearing on the oscillator terminal 50 through resistor R6. As shall subsequently be seen, the inductor L2 is a variable inductor comprised of a fixed coil with a movable plunger disposed coaxially therewith and moving in response to a respective one of the keys. The resonant frequency of the circuit comprised of inductor L2 and capacitor C6 is given by the equation $W = \sqrt{1/L2C6}$. A comparison of this equation with the equation for the oscillator frequency of the oscillator of FIG. 6 shows that if C6 equals C4, and L1 equals L2, the resonant frequency of the tuned circuit of FIG. 7 will represent the oscillator frequency of the oscillator of FIG. 6. Accordingly, if the capacitor selected for C6 is the same in value and characteristics as the capacitor used for capacitor C4 and further, inductor L1 is the same in construction as the variable inductor L2 but with the movable member 6 permanently disposed at a predetermined relation thereto, the oscillator frequency and the resonant frequency of the tuned circuit of FIG. 7 may be made equal for one key position (key up or key depressed depending upon which is desired). Further it will be noted that by choosing the capacitors and inductors as hereabove stated, the circuits are basically temperature tracking so that the oscillator frequency will track the changes in the resonant frequency of the tuned circuits of FIG. 7 with temperature.

The tuned circuits together with resistor R6 provides a voltage divider coupled to the base of transistor T6. The emitter of transistor T6 is coupled to ground through a capacitor C7, and is coupled to the base of transistor T7 through resistor R7. The collector of transistor T6 is coupled to the positive power supply terminal 44, whereas the collector of transistor T7 is also coupled to this terminal through resistor R8. Accordingly, if the voltage on the base of transistor T6 exceeds the base emitter diode voltage of transistors T6 and T7, transistors T6 and T7 will be turned on and the voltage on the output terminal 52 will approach that of terminal 42, e.g., a low logic level. On the other hand, when the voltage on the base of transistor T6 is less than the base emitter diode voltage of transistors T6 and T7, transistor T7 will be turned off and the voltage on terminal 52 will be substantially equal to the voltage on terminal 44, the high logic level voltage.

Transistors T6 is coupled as a switching transistor to rectify the a.c. voltage appearing on line 54. Whenever the voltage on this line exceeds the base emitter diode voltage of transistor T6, the transistor tends to turn on to charge capacitor C7 to a voltage equal to the voltage of line 54 minus the base emitter voltage of transistor T6. Accordingly, the combination of transistor T6 and capacitor C7 provides a peak detector, with the capacitor C7 maintaining the voltage at point 56 substantially constant during any one cycle so as to provide a d.c. drive for the base of transistor T7 which, depending upon the value of the inductor, will be adequate to maintain transistor T7 in the on condition. Accordingly, it may be seen that if the peak positive voltage swing of line 54 exceeds the base emitter diode voltage of transistor T7 plus the base emitter diode voltage of transistor T6, transistor T7 will be turned on; otherwise, while transistor T6 may be partially turned on by the positive voltage on line 54, the voltage on the base of transistor T7 will be inadequate to turn that transistor on.

From the foregoing, it may be seen that there is a threshold voltage for the voltage swing on line 54 below which a high logic level will appear at terminal 52 and above which a low logic level will appear at terminal 52. Using silicon transistors, the positive voltage peak swing for this threshold is approximately 1.4 volts, and the variation in inductor L2 may readily control the voltage swing of line 54 to unambiguous levels above and below that threshold.

Now referring to FIGS. 2 and 3, details of the construction of the present invention may be seen. The steno machine mechanism generally has a pair of side frame members 54 with an integral base member 56 attached to a second base member 58, having outward extending flange members 60. In the present invention, one circuit board 62 is supported from each of the flange members 60 by a bracket 64 and screws 66. Each of the circuit boards is a printed circuit board, in the preferred embodiment containing the required circuit interconnections for 12 circuits of FIG. 7, less the inductors L2, and each further containing the interconnections for the oscillator circuit FIG. 6. However, only one of the circuit boards 62 actually contains the components for the oscillator circuit of FIG. 6, and an appropriate interconnection is made between the two circuit boards so that the single oscillator circuit provides the required reference frequency for both circuit boards. There is also provided a circuit board 68 on which a plurality of inductors L2 together with the plunger and return springs are located. For the particular steno machine shown, it is most convenient to place 22 inductors L2 on the circuit board 68, as a single flat printed circuit type circuit board may be used to provide the required interconnections and a suitable support base for the inductors. The two additional sensors, one being the any key bar sensor, are each mounted in a plastic block 70. The block, supported by screw 74, merely provides structural mounting member to appropriately dispose the respective plungers, and the construction of the inductors L2, plungers and return springs are in general the same as that used on board 68. In FIG. 3 the plurality of inductors L2 extending below the board 68 may be seen, as well as the plurality of plungers 98 extending thereabove.

Now referring more specifically to FIGS. 4 and 5, a top view of the board 68 and a cross section thereof respectively may be seen. The board 68 is appropriately disposed and retained below the key bars 32 by screws 78 and is provided with a plurality of holes 80, each disposed so as to be vertically aligned with a respective one of the key bars. Each of the holes 80 in this embodiment are provided with an enlarged annular region 82 adjacent the top thereof, so that a coil spring 84 may project downward thereinto. A circular coil bobbin 86 (typically nylon or other self lubricating plastic material) is provided having an integral upward extending tubular member 88, which extends upward through hole 80 to a level approximately coplanar with the top surface of the board 68. The coil bobbin 86 is wound with coil 90, and after being cemented in position, the leads of coil 90 are connected to a printed circuit on the lower surface of circuit board 68 so as to be interconnected with the appropriate terminals of connectors 92, also fastened to the board 68. In the preferred embodiment, connectors 92 are 14 pin integrated circuit plugs for receiving a mating connector fastened to a flex print cable 94 having a similar connector 96 for attaching to a similar plug on boards 62 (see FIG. 2). Since the key bars are relatively closely spaced in a typical machine, two rows of inductors etc. are utilized in the present invention, spaced in fore and aft disposition, so as to stagger the inductor coils to allow larger coils to be used.

Aligned with each of the coils L2 and slidably disposed coaxially therewith is a plunger 98 having an enlarged head 100 thereon. The coil springs 84 are wound with the top turn or two having a smaller diameter than the remainder of that coil, so that once pushed over the shaft of the plunger 98 the top of the coil spring 84 will be elastically retained on plunger 98 just below the head 100 thereof to form a semi-permanent assembly. The remainder of the coil 84 preferably has a predetermined diameter which is slightly larger than plunger 98, but which is also slightly smaller than the tubular extension 88 on the bobbin 86. Thus, by twisting the plunger and coil spring in the proper direction so as to tend to unwind the coil spring while pushing the plunger downward into its desired position, the bottom turn on the coil spring 84 will open slightly to pass over the tubular extension 88 to elastically grasp the extension and be semi-permanently assembled thereto. The retention of the coil spring on the tubular extension and on the plunger will be improved if the coil spring contains a closed coil at each end thereof. By having the coil spring grasp the various components as hereabove described, the plungers may be assembled as shown and will not fall out if the board 68 is inadvertently turned over prior to assembly into the machine.

The response of the inductor L2 to the position of the plunger 98 depends in part upon the selection of the material of the plunger, and the frequency at which the system is operated. In the preferred embodiment, the frequency of the oscillator is chosen to be approximately $10^5$ Hertz. The plunger materials which may be used range from materials having a reasonably high permeability and a very low electrical conductivity. By way of specific example, the plungers 98 may be made out of a ferrite material or may be solid copper. For a ferrite material, the primary effect on motion of the plunger 98 is a change in the inductance of the inductor L2, so as to change the resonant frequency of the tuned circuit. This is illustrated in FIG. 8A where the voltage on line 54 (FIG. 7) versus the frequency applied at terminal 54 (assuming a constant voltage) is shown for the two plunger positions. Of course, plunger depression causes a higher inductance and therefore a lower resonant frequency as illustrated. It may readily be seen that if the operation frequency is chosen to coincide with the peak of either curve, the amplitude of the voltage on line 54 when the plunger is in the opposite direction, will normally be very low, and by choice of components may readily be made to be less than the diode voltage drop of the two transistors T6 and T7. If a copper plunger is used, the primary effect of plunger motion is to change the Q of the circuit, with only a minor effect upon the resonant frequency of the circuit. This is illustrated in FIG. 8B.

In the preferred embodiment, it has been found that while various special materials such as ferrites, copper etc. may be used to get the desired results, the desired circuit operation may also be achieved by other materials having greater structural integrity and being generally commercially available in the general shape desired without requiring machining, grinding etc. These materials generally are magnetic materials having a substantial electrical conductivity, such as by way of example, common steels as are used in conventional nails. By way of specific example, it has been found that proper circuit operation is achieved with non-critical circuit elements values by cutting conventional, commercially available nails to the appropriate length and providing a cadmium plating or other surface finish to prevent the corrosion thereof. Such a plunger effects both the Q of the circuit and the inductance, and thus the resonant frequency thereof. Accordingly, with the plunger up, the frequency and the Q are relatively high whereas with the plunger down the resonant frequency and the Q are reduced. This is illustrated in FIG. 8*c*.

Referring again to FIG. 7, it will be noted that by making the voltage on the input terminal 44 (+5) volts, the logic signals appearing on terminals 52 will be in accordance with standard TTL logic levels. Also, since the rectification achieved by transistor T6 is basically through an emitter follower type of circuit and the voltage amplification achieved by transistor T7 is achieved through a grounded emitter circuit, these two transistors provide a highly sensitive threshold detector for the AC signal appearing on line 54, and accordingly substantial variations in circuit elements etc. may be tolerated and still achieve the distinctive and unambiguous logic level outputs desired.

Now referring to FIG. 9, a block diagram of an output control system which may be utilized with the keyboard switch system of the present invention may be seen. A register 100 is provided having a parallel in, serial out capability to receive the logic signals representing the 23 key positions, generally indicated as the signals on lines 52. In the preferred embodiment, the register is comprised of six integrated circuit registers manufactured by Texas Instruments and sold as their part number SN-7494N. These devices are each four bit parallel or serial input, serial output devices having an input enable and an input latch, the input latch having the characteristic of latching an input in the high state if the respective input is at the high state at any time while the enable signal is on. Of course, the any key position signal appearing on the 24 line 52 is utilized as the input enable. The switch electrically accomplishes in the register 100 the mechanical function of the any key bar as previously described.

The Master Clock 102, which in the preferred embodiment operates at 24 KHz, provides a clock signal to a counter 104, which is also controlled by the any key position signal, so that after the any key position signal cycles and the 23 key positions are loaded into the register 100, the counter 104 may clock out the register information on line 106.

The disposition of the information appearing on line 106 is controlled by control 108. The function of the control 108 is to control the direction of the information on line 106 to either memory 110 or memory 112 (e.g. memory A or memory B) both of which memories are serial-in, serial-out memories having a substantial memory capacity. The control 108 is synchronous with the master clock 102 and controls the flow of information appearing on line 106 by providing a control logic signal on line 114 for enabling the input to the memories by means of NAND gates 116 and 118 having inverse inputs created by inverter 120. Accordingly, the control directs flow of information to only one memory at a time. Further, the control is adopted to provide a memory output clock signal (synchronous to the master clock signal 102) on lines 122 or 124 to clock out the information in one memory while the other memory is receiving information from the register 100. OR gate 126, being responsive to either memory output, provides an output on line 128 which is a bit-serial word-serial presentation of the information as recorded simultaneously by the steno machine operator on the conventional paper tape. The control 108 will also typically provide a control signal on line 130 to control the device receiving the information on line 128, which in the preferred embodiment is a conventional tape recorder. Of course, additional bits may be added as desired for word-end, sequence-end etc. depending upon the particular requirements of the specific system etc.

It should be noted that in the system described hereabove with respect to FIG. 9, the device receiving the information appearing on line 128, such as a tape recorder, need not be continuously operating but may be intermittently operating to receive and record the information as memory A or memory B is dumped. Thus, a great quantity of information may be stored on conventional magnetic tape by a conventional recorder. In the preferred embodiment, the use of a 24 KHz master clock provides an output time of approximately 1 millisecond for an entire 24 bit (23 bit) word, so that the memories A and B may be dumped at a rate substantially faster than even the fastest steno operators. Also, it should be noted that while in the system described the information is clocked into the memories A and B at the same clock rate as it is clocked out of the memories, this is not a requirement and a different (higher) output clock rate may readily be utilized to clock the information directly into a computer, if desired, on a time shared basis so as to provide immediate transcription in a time shared system. Accordingly, utilization of a pair of temporary storage memories allows for maximum utilization and efficiency of a storage or transcribing system receiving the signal on line 128, as opposed to an equivalent system receiving individual words on line 106. Furthermore, it is obvious that while a serial out on line 128 has been described, a bit parallel word serial output may also readily be provided, depending upon the particular requirements of the device receiving the signal. This and other changes will be readily apparent to one skilled in the art. Thus, while the present invention has been disclosed and described with respect to a specific embodiment thereof, it will be understood by those skilled in the art that various changes in form and detail may be made therein without departing from the spirit and scope of the invention.

I claim:

1. A sensor for sensing key positions in a keyboard system comprising:

a coil means having a coil of wire with first and second coil leads, a capacitance means having first and second leads coupled to said first and second leads of said coil means so that said coil means and said capacitance means define a tuned circuit, a plunger means disposed generally coaxial with said coil means and being slideable between first and second locations with respect thereto, said plunger means being fabricated of a selected material so as to result in an impedance of said coil means when said plunger is in said second location which is substantially different from the impedance of said coil when said plunger is in said first location, means for supply electrical power at a fixed frequency to said tuned circuit, and means for providing an output signal at said fixed frequency and modulated in amplitude responsive to the changes in said tuned circuit due to changes in the impedance of said coil.

2. The sensor of claim 1 wherein said selected material of said plunger means is a magnetic material.

3. The sensor of claim 1 wherein said selected material is a material having a substantial electrical conductivity.

4. The sensor of claim 1 further comprised of a spring means coupled between said plunger means and said coil means to yieldably encourage said plunger means to said first position.

5. The sensor of claim 1 wherein said means for providing an output signal responsive to the changes in the impedance of said coil is a detector means responsive to the amplitude of the voltage appearing across said coil means, and further includes means for providing first and second logic signals in response to changes in said impedance of said coil.

6. A keyboard system comprising:

a plurality of sensors, each having a coil means having a coil of wire wound on a nonmagnetic core with first and second coil leads, a capacitance means having first and second leads coupled to said first and second leads of said coil means so that said coil means and said capacitance means define a tuned circuit, a plunger means disposed generally coaxial with said coil means and being slideable between first and second locations with respect thereto, said plunger means being fabricated, at least in part, of a selected material so as to result in an impedance of said coil means when said plunger is in said second location which is substantially different from the impedance of said coil when said plunger is in said first location, means for supplying electrical power at a fixed frequency from an oscillator to said tuned circuits of each of said plurality of sensors through an impedance means, means for providing a signal at said fixed frequency and modulated in amplitude responsive to the changes in each of said tuned circuits due to changes in the impedance of said coils, and for providing first and second logic output signals in response thereto, a register means, including means for entering said output signals of the remaining sensors responsive to the output signal of one of said sensors, first and second memory means and control means, said control means being a means for alternately directing signals from said register means to one of said first and second memory means and for causing the other of said first and second memory means to present at its output the information previously stored therein.

7. The keyboard system of claim 6 further comprised of a plurality of spring means, each between one of said plunger means and the respective said coil means to yieldably encourage each said plunger means to said first position, whereby a part of a key assembly may contact a respective said plunger, and force said plunger to said second position upon depression of the respective key.

8. The keyboard system of claim 6 wherein said means for providing an output signal responsive to the changes in the impedance of said coil is a detector means responsive to the amplitude of the voltage appearing across said coil means.

9. The keyboard system of claim 8 wherein said impedance means is a resistor.

10. The keyboard system of claim 6 further comprised of a circuit board and a plurality of spring means, said circuit board having said coil means attached thereto in a predetermined pattern with the axis of each said coil means being perpendicular to said circuit board, said circuit board having a plurality of holes therethrough, each coaxial with one of said coil means to provide an opening for said plungers, each said spring means being coupled between said plunger and said circuit board for yieldably retaining said plunger at said first position, whereby siad circuit board may be mounted in a keyboard machine so that said plungers are contacted by members responsive to key positions to move said plungers between said first and second positions.

11. The sensor of claim 1 wherein said coil means comprises a coil of wire wound on a nonmagnetic core.

12. A keyboard sensing system comprising a plurality of sensors arranged in a predetermined pattern, each having an inductor coil in series with an impedance, and a moving member coaxial with each said inductor coil for moving between first and second positions, said moving member being fabricated at least in part of a material which causes a substantial change in impedance of said inductor coil when said moving member moves between said first and second positions, said moving members each having a spring yieldably encouraging each said moving member to said first position, said predetermined pattern being chosen whereby said keyboard sensing system may be disposed below the key mechanism on a keyboard so that a respective one of said moving members will be forced to said second position upon depression of the respective key, an oscillator coupled to each series combination of said inductor coil and an impedance for providing a substantially constant amplitude and frequency signal thereto, and means coupled to each indicator coil to provide logic signal outputs responsive to the change in the amplitude of the voltage across said inductor coil at said substantially constant frequency.

13. The keyboard sensing system of claim 12 wherein said indicator coils are wound on nonmagnetic cores.

14. The keyboard sensing system of claim 13 wherein said impedance in series with each said inductor coil is a resistor, and further comprised of a capacitor in parallel with each said inductor coil.

* * * * *